US006730011B2

(12) United States Patent
Tokiwa et al.

(10) Patent No.: US 6,730,011 B2
(45) Date of Patent: May 4, 2004

(54) PRINTING-SPEED-RESPONSIVE JAW SPACING ADJUSTMENT SYSTEM FOR A JAW CYLINDER AT THE FOLDING STATION OF A WEB-FED PRINTING PRESS

(75) Inventors: Shizurou Tokiwa, Kanagawa (JP); Takanobu Sakakura, Tokyo (JP); Mutsuhito Yoneta, Tokyo (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 10/377,794

(22) Filed: Mar. 4, 2003

(65) Prior Publication Data

US 2003/0232710 A1 Dec. 18, 2003

(30) Foreign Application Priority Data

Jun. 14, 2002 (JP) ..... 2002-173880

(51) Int. Cl.[7] ..... B31B 1/26

(52) U.S. Cl. ..... 493/405; 493/424; 493/428; 270/52.14

(58) Field of Search ..... 493/405, 424, 493/428, 434, 442; 270/32, 52.14

(56) References Cited

U.S. PATENT DOCUMENTS 5,037,365 A * 8/1991 Breton ..... 493/18
5,405,127 A * 4/1995 Welborn ..... 270/21.1
5,571,069 A * 11/1996 Shah ..... 493/357
5,847,177 A * 12/1998 Sangokoya et al. ..... 556/179
6,082,724 A * 7/2000 Kahlig et al. ..... 270/52.14
6,273,313 B1 * 8/2001 Noll et al. ..... 226/30
6,279,890 B1 * 8/2001 Tomczak ..... 270/21.1
6,511,409 B2 * 1/2003 Hachiya et al. ..... 493/424
6,514,188 B2 * 2/2003 Kostiza ..... 493/424

FOREIGN PATENT DOCUMENTS

JP 07-055761 B1 7/1990

* cited by examiner

*Primary Examiner*—Eugene L Kim
(74) *Attorney, Agent, or Firm*—Rader, Fishman & Grauer PLLC

(57) ABSTRACT

A printed paper web or any required number of such web in superposition are cut into sections at the folding station of a rotary printing press. Each web section has its midpart subsequently pushed into one of the jaw cavities in a jaw cylinder, therein to be engaged and folded by a fixed and a movable jaw. Both jaws are mounted to separate, independently movable parts of the jaw cylinder, to which is coupled a jaw spacing adjustment mechanism for moving the jaws toward and away from each other in order to vary the spacing therebetween in any operating phase of the movable jaw relative to the fixed jaw. In order to adjust the jaw spacing to the running speed of the press, as well as to the number of webs being processed jointly, a jaw spacing adjustment circuit is provided which puts out a signal indicative of a desired jaw spacing suiting both the press speed and the web thickness, for delivery to a stepper motor driving the jaw spacing adjustment mechanism.

6 Claims, 7 Drawing Sheets

PRINTING-SPEED-RESPONSIVE JAW SPACING ADJUSTMENT SYSTEM FOR A JAW CYLINDER AT THE FOLDING STATION OF A WEB-FED PRINTING PRESS

BACKGROND OF THE INVENTION

1. Field of the Invention

This invention relates to a folding station appended to a web-fed printing press, as in newspaper production, for cutting the printed paper web into sections and folding the successive web sections each in the middle into the form of signatures. More particularly, the invention deals with a jaw cylinder at the folding station which has sets of fixed and movable jaws arranged at circumferential spacings thereon for folding the web sections as they are thrust into the jaw cavities. Still more particularly, the invention pertains to a system for automatically adjusting the spacing between the fixed and movable jaws to the operating speed of the printing press.

2. Description of the Prior Art

The web sections to be engaged by the jaws on the jaw cylinder are subject to substantive change in thickness even in the limited case of newspaper production. The paper in use may itself vary in thickness. What is more, the pages of each signature to be produced can vary considerably in number as two or more webs are concurrently printed and superposed one upon another before being fed into the folding station for production of multiple-page signatures. The spacing between each set of fixed and movable jaws must be adjustable to such widely different thicknesses of the web sections to be folded, in order to create proper folds without doing any harm to the printed paper. The jaws must nevertheless capture the web sections firmly enough to avert accidental disengagement as the web sections are subsequently folded into signatures.

Japanese Patent Publication No. 7-55761 is hereby cited as prior art on the subject of jaw spacing adjustment. It teaches to sense the thickness of the printed web or webs being introduced into the folding station and to vary the spacing between the fixed and movable jaws accordingly.

More recently, however, such thickness-dependent adjustment of jaw spacing has proved insufficient for the proper functioning of the jaw cylinder as a result of remarkable rise in the running speed of the printing press. Let it be supposed that the jaw spacing is now set properly for a given web thickness and at a given running speed of the press. Then, according to the prior art thickness-dependent adjustment of jaw spacing, the web sections were easy to fall off the jaws when the press speed was made higher, particularly in the case of production of multiple-page signatures.

Let us now briefly study the makeup of the folding station of the rotary printing press in order to learn in some more detail the problems involved in jaw spacing adjustment. The folding station has a cutter cylinder and a folding cylinder in addition to the jaw cylinder, which cylinders are all in constant rotation during the progress of printing. The printed web of paper is first wrapped around part of the folding cylinder and, while traveling thereover, cut into successive sections by cutting blades on the cutter cylinder which is held against the folding cylinder via the web. The folding cylinder is equipped with elongate folding blades each extending parallel to the folding cylinder axis and arranged at circumferential spacings thereon. Each folding blade is movable radially of the folding cylinder.

Pushed off the surface of the folding cylinder by one of the folding blades, each web section has its midpart inserted in one of the elongate jaw cavities which are cut in the surface of the jaw cylinder at circumferential spacings. The midpart of the web section that has been pushed into the jaw cavity is therein engaged, together with the folding blade, between the fixed and movable jaws as the movable jaw is closed against the fixed jaw, and thereby folded along the centerline of the web section. The web section is subsequently carried away from the surface of the folding cylinder by the jaw cylinder as these cylinders continue rotation in opposite directions. The folding blade withdraws from between the fixed and movable jaws just after the web section has been thereby engaged, so that the web section is folded along the centerline while being carried away from the folding cylinder.

When the web section is pulled off the folding cylinder as above after having its midpart captured by the jaws, the leading half of the web section must travel in sliding contact with the folding cylinder. An inertial force will then act on the web section, tending to pull the web section out of engagement with the jaws in opposition to spring pressure being exerted on the jaws. The greater the mass of the web section, or the more the number of webs superposed, the stronger will be the centrifugal pull of the web section. Actually, the web sections fell off the jaws in the worst case.

Obvious solutions to this problem might be to make the jaw spacing narrower, to employ heavier springs for the movable jaws, or both. These solutions are unsatisfactory because, at lower running speeds of the press, ink offset would occur between the contacting surfaces of the web sections being folded.

SUMMARY OF THE INVENTION

The present invention seeks, in connection with the folding station of a rotary printing press, to automatically adjust the jaw spacing to the running speed of the printing press in order to minimize the risks of accidental disengagement of the web sections from the jaws and of ink offset between their contacting surfaces.

Another object of the invention is to make automatic adjustment of the jaw spacing depending not only upon the running speed of the press but also upon the mass of each web section to be folded or the pages of the signatures to be made.

In summary the present invention concerns a speed-responsive jaw spacing adjustment system for a jaw cylinder at the folding station of a web-fed printing press where one or more webs of printed paper are cut into successive sections, and each web section folded into a signature. The jaw cylinder is conventionally furnished with a fixed and a movable jaw, the latter being movable toward and away from the former for engaging and folding each web section as its midpart is inserted therebetween. The fixed and movable jaws are, moreover, mounted to separate, independently movable parts of the jaw cylinder which are coupled to jaw spacing adjustment means to permit adjustment of the spacing therebetween in any operating phase of the movable jaw relative to the fixed jaw. The jaw spacing adjustment means have their own drive means including a bidirectional electric drive motor such as a stepper motor.

For controllably energizing the drive motor according to the running speed of the printing press, the jaw spacing control system comprises a press speed circuit for providing a press speed signal indicative of the speed at which the web is currently being fed into the folding station, and a jaw spacing circuit for providing a jaw spacing signal indicative of the current actual spacing between the fixed and the movable jaw. Connected to these circuits is a jaw spacing adjustment circuit which puts out, in response to the incoming press speed signal and jaw spacing signal, a jaw spacing adjustment signal for adjustment of the jaw spacing to the current press speed. The jaw spacing adjustment circuit has its output connected to the drive motor for causing the same to drive the jaw spacing adjustment means in response to the jaw spacing adjustment signal.

More specifically, the jaw spacing adjustment circuit responds to the incoming press speed signal by determining an optimal jaw spacing for the current press speed and compares this optimal jaw spacing with the actual jaw spacing indicated by the jaw spacing signal. If a difference proves to exist between the desired and the actual jaw spacing, then the adjustment circuit produces the jaw spacing adjustment signal for elimination, or reduction to a tolerable range, of that difference.

Preferably, in cases where the printing press is designed for concurrent printing of a variable number of webs for production of signatures of a variable number of pages, the jaw spacing may be adjusted not only to the press speed but also to the number of webs to be processed jointly. Toward this end there may be additionally provided an input device for inputting data indicative of how many webs are processed simultaneously, and a memory for storing a table indicative of desired jaw spacings for various combinations of a series of different press speeds and a series of different web numbers. Inputting the web number data in addition to the press speed signal and actual jaw spacing signal, the jaw spacing adjustment circuit can be made to read out from the memory the desired jaw spacing suiting the particular combination of the current press speed and current web number.

Thus, at whatever speed the press may be run, the jaw spacing is automatically readjusted to that press speed for engaging and folding the web sections under optimum pressure. The web sections of any of predetermined different thicknesses are not to accidentally fall off the jaws at high press speed, nor is ink offset to occur between their contacting surfaces at low press speed. All in all, the jaw spacing adjustment system has proved to contribute immensely to the production of printings of invariably high quality and to the reduction of press downtime.

The above and other objects, features and advantages of this invention will become more apparent, and the invention itself will best be understood, from a study of the following description and appended claims, with reference had to the attached drawings showing the preferred embodiment of the invention.

DESCRIPTION OF THE PREFERRED EMBODIMENT

Folding Station

Figure 1:
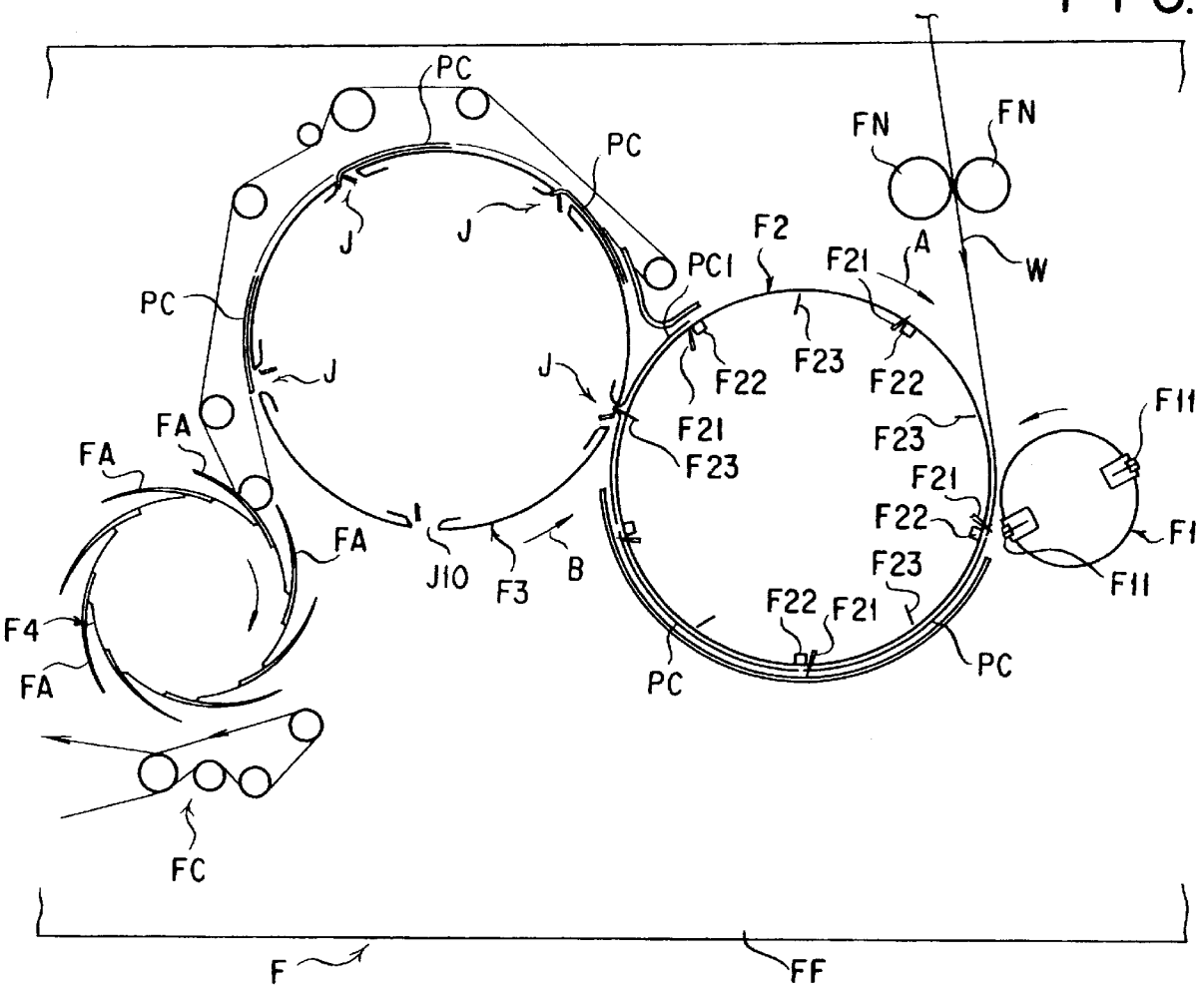
FIG. 1 is a diagrammatic illustration of a folding station of a web-fed printing press including a jaw cylinder to which is applicable the present invention.

The present invention is currently considered best applicable to the folding station of a rotary printing press that is constructed to print two or more webs of paper at the same time for joint processing into multiple-page signatures, although of course only one web of paper may be printed. As depicted diagrammatically in FIG. 1, the exemplified folding station F has a pair of feed rollers FN for frictionally introducing a continuous web or webs W of printed paper into the folding station F. Although in practice any required number of webs may be printed concurrently and introduced in superposition into the folding station F, it is assumed for simplicity of description that only one printed web W is now being fed into the folding station. The usual practice in the art is to fold the printed web longitudinally as by a former, not shown, which is positioned upstream of the folding station F.

The folding station F has a cutter cylinder $F_1$, a folding cylinder $F_2$, a jaw cylinder $F_3$, and a delivery fan $F_4$, for cutting the printed web W into sections PC, folding each web section in the middle into a signature, and delivering the successive signatures. All the cylinders $F_1$–$F_3$ and the fan are $F_4$ rotatably mounted between a pair of confronting framing walls FF, one shown. A delivery conveyor FC underlies the delivery fan $F_4$.

The cutter cylinder $F_1$ has one or more, two shown, cutting blades $F_{11}$ in circumferentially spaced-apart positions thereon, with each blade extending parallel to the cutter cylinder axis. The folding cylinder $F_2$ has a plurality of, five in this embodiment, anvils or beds $F_{22}$ at constant circumferential spacings on its surface for mating engagement successively with the cutting blades $F_{11}$ on the cutter cylinder $F_1$. Rows of retractable piercing pins $F_{21}$ are also mounted to the surface of the folding cylinder $F_2$, in positions immediately upstream of the anvils $F_{22}$ with respect to the arrow-marked direction of rotation of the folding cylinder. Wrapped around part of the folding cylinder $F_2$, the web W will be engaged by the successive rows of piercing pins $F_{21}$ and cut transversely into sections PC as the two cutting blades $F_{11}$ on the cutter cylinder $F_1$ alternately engage in the successive anvils $F_{22}$ on the folding cylinder $F_2$. The web sections PC will then ride on the folding cylinder $F_2$ with their leading edges held engaged by the piercing pins $F_{21}$.

The jaw cylinder $F_3$, which is shown to be of the same diameter as the folding cylinder $F_2$, has defined in its surface a plurality, five in this embodiment, jaw cavities $J_{10}$ at constant circumferential spacings. Carried by the folding cylinder $F_2$ to a position opposite one of the jaw cavities $J_{10}$ in the jaw cylinder $F_3$, each web section PC will have its leading edge released from the piercing pins $F_{21}$ as the latter then retract into the folding cylinder $F_2$. Concurrently, the web section PC will have its midpart pushed by one of folding blade $F_{23}$ on the folding cylinder $F_2$ off its surface into one of the jaw cavities $J_{10}$ in the jaw cylinder $F_3$. The inserted midpart of the web section FS is therein to be engaged by one set of fixed and movable jaws to be set forth in detail subsequently. The jaws are not shown in this figure for lack of space but merely indicated by the capital J.

The folding blade $F_{23}$ will be subsequently withdrawn out of engagement with the jaws J, leaving the web section PC captured by the jaws in order to be folded. As the folding cylinder $F_2$ and jaw cylinder $F_3$ continue rotation in opposite directions, the web section PC will ride from folding cylinder onto jaw cylinder and, by so doing, be folded along the centerline.

Positioned between jaw cylinder $F_3$ and delivery conveyor FC, the delivery fan $F_4$ has a plurality of vanes FA mounted slantingly on its surface to define pockets. The folded web sections or signatures PC are to drop successively by gravity from the jaw cylinder $F_3$ into these pockets on the delivery fan $F_4$ and thence onto the delivery conveyor FC.

The construction of the folding station F as so far described is conventional, and therein lies no feature of the instant invention. The novel features of the invention will appear in the course of the following detailed description of the jaw cylinder, sets of jaws together with their drive means, a jaw spacing adjustment, a drive mechanism for the jaw spacing adjustment, and electronic controls for automatic, speed-responsive adjustment of the jaw spacing.

Jaw Cylinder

Broadly, the jaw cylinder $F_3$ is constituted of the following three parts which are each of one-piece construction:

1. An inner end part 11 including a pair of inner end plates $\mathbf{11}_a$ and $\mathbf{11}_b$, FIGS. 2 and 3.
2. An outer end part 12 including a pair of outer end plates $\mathbf{12}_a$ and $\mathbf{12}_b$, FIGS. 2 and 4.
3. A core part 13 which forms the core of the jaw cylinder $F_3$ and upon which both inner end part 11 and outer end part 12 are mounted for independent rotation within limits.

Figure 3:
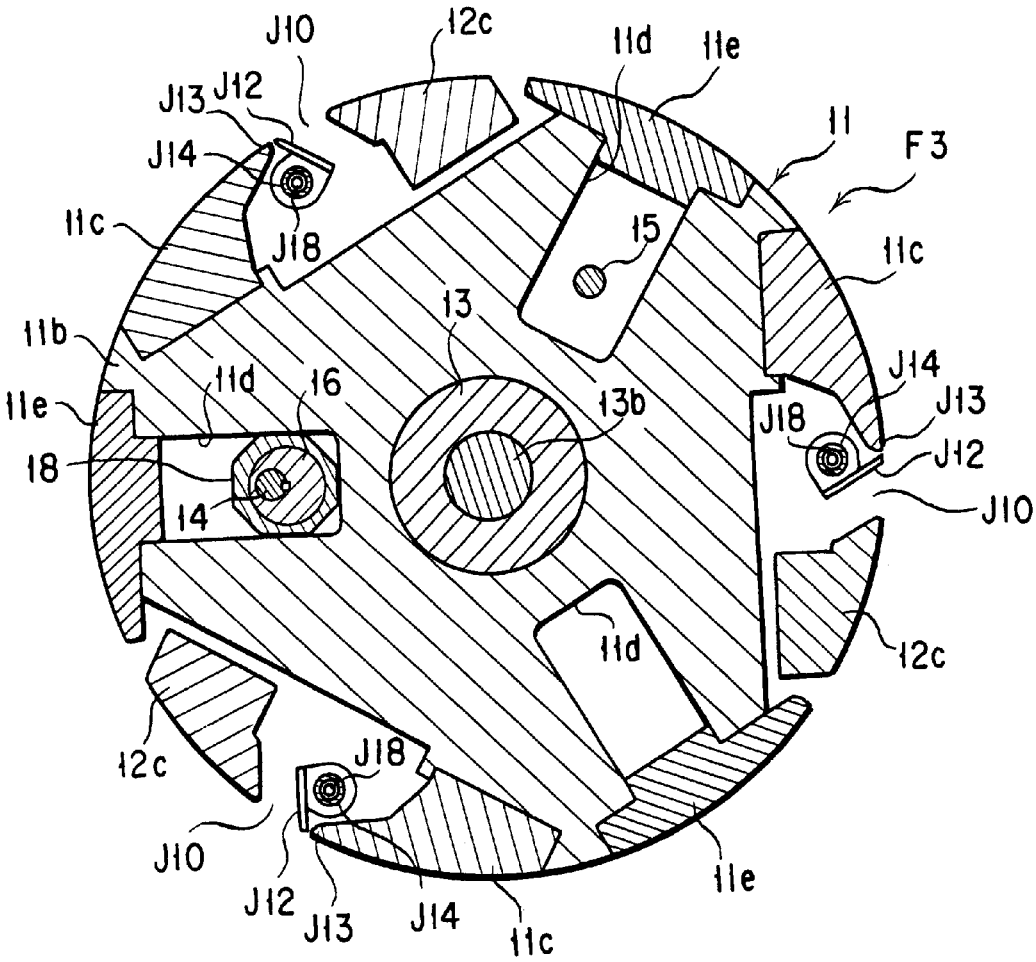
FIG. 3 is a section taken along the line III—III in FIG. 2.

The inner end part 11 additionally includes a plurality of, three shown in FIG. 3, ties $\mathbf{11}_c$ joining the pair of inner end plates $\mathbf{11}_a$ and $\mathbf{11}_b$ and forming parts of the surface of the jaw cylinder $F_3$. One of the opposite longitudinal edges of each tie $\mathbf{11}_c$ is shaped into a fixed jaw $J_{13}$ forming a part of the jaw means set forth with reference to FIG. 3. Each of the inner end plates $\mathbf{11}_a$ and $\mathbf{11}_b$ has cut therein at least two slots $\mathbf{11}_d$ each extending radially from its outer edge and terminating short of its inner edge surrounding the core part 13. The outer ends of all the slots $\mathbf{11}_d$ are tightly closed by caps $\mathbf{11}_e$. The purposes for which the slots $\mathbf{11}_d$ are provided will become apparent from the subsequent description of the jaw spacing adjustment.

Figure 4:
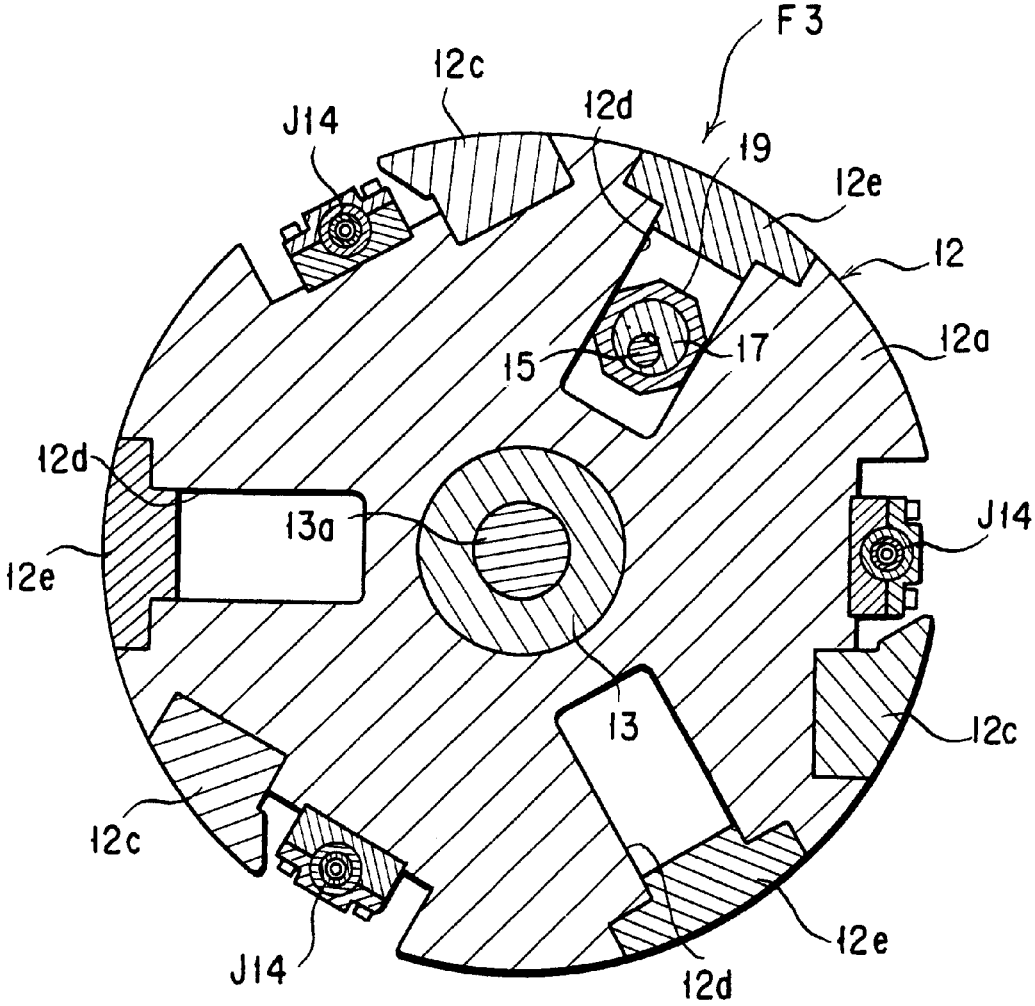
FIG. 4 is a section taken along the line IV—IV in FIG. 2.

The outer end part 12 likewise additionally comprises a plurality of, three shown in FIG. 4, ties $\mathbf{12}_c$ joining the pair of outer end plates $\mathbf{12}_a$ and $\mathbf{12}_b$ of approximately disc-like shape. A reference back to FIG. 3 will reveal that each outer end part tie $\mathbf{12}_c$ is positioned between one inner end part tie $\mathbf{11}_c$ and one cap $\mathbf{11}_e$, thus forming parts of the surface of the jaw cylinder $F_3$. Each neighboring pair of inner end part tie $\mathbf{11}_c$ and outer end part tie $\mathbf{12}_c$ are spaced from each other circumferentially of the jaw cylinder $F_3$ to define one of the three jaw cavities $J_{10}$ set forth in connection with FIG. 1. Each of the outer end plates $\mathbf{12}_a$ and $\mathbf{12}_b$ is shown to have three radial slots $\mathbf{12}_d$, FIG. 4, cut therein for purposes to be set forth in connection with the jaw spacing adjustment. The outer ends of the slots $\mathbf{12}_d$ are firmly closed by caps $\mathbf{12}_e$.

The core part 13 has a larger diameter portion $\mathbf{13}_z$ with a pair of smaller diameter portions $\mathbf{13}_c$ and $\mathbf{13}_f$ coaxially extending from its opposite ends. The larger diameter portion $\mathbf{13}_z$ of the core part 13 has a plurality of lugs $\mathbf{13}_d$ extending radially from its opposite ends in alignment along the jaw cylinder axis. Each aligned pair of lugs $\mathbf{13}_d$ are interconnected by a tie, not shown, extending parallel to the jaw cylinder axis. The pair of smaller diameter portions $\mathbf{13}_e$ and $\mathbf{13}_f$ of the core part 13 has rotatably mounted thereon the pair of inner end plates $\mathbf{11}_a$ and $\mathbf{11}_b$ of the inner end part 11 and the pair of outer end plates $\mathbf{12}_a$ and $\mathbf{12}_b$ of the outer end part 12. A retainer plate $\mathbf{13}_g$ is secured to the left hand smaller diameter portion $\mathbf{13}_g$.

Coaxially coupled to the smaller diameter portions $\mathbf{13}_e$ and $\mathbf{13}_f$ are a pair of journals $\mathbf{13}_a$ and $\mathbf{13}_b$ which are rotatably supported by the pair of confronting framing walls $FF_a$ and $FF_b$. The right-hand journal $\mathbf{13}_a$ is mounted to the right-hand framing wall $FF_a$ via a set of bearings $B_a$ and bearing sleeve $S_a$. The left-hand journal $\mathbf{13}_b$ is mounted to the left-hand framing wall $FF_b$ via a set of bearings $B_b$, a bearing sleeve $S_c$, another set of bearings $B_c$ around the bearing sleeve $S_c$, and another bearing sleeve $S_b$ around the bearings $B_c$.

The left-hand journal $\mathbf{13}_b$ of the jaw cylinder $F_3$ has a jaw cylinder drive gear GG mounted fast on its end projecting outwardly of the framing wall $FF_b$. Driven by another drive gear DG, the drive gear GG is to impart rotation to the jaw cylinder $F_3$. The jaw cylinder drive gear GG, as well as the other drive gear DG, takes the form of a helical gear as it is intended to perform additional functions in connection with the drive mechanism 30 for the jaw spacing adjustment 20.

Jaws and Jaw Drive Means

Figure 2:
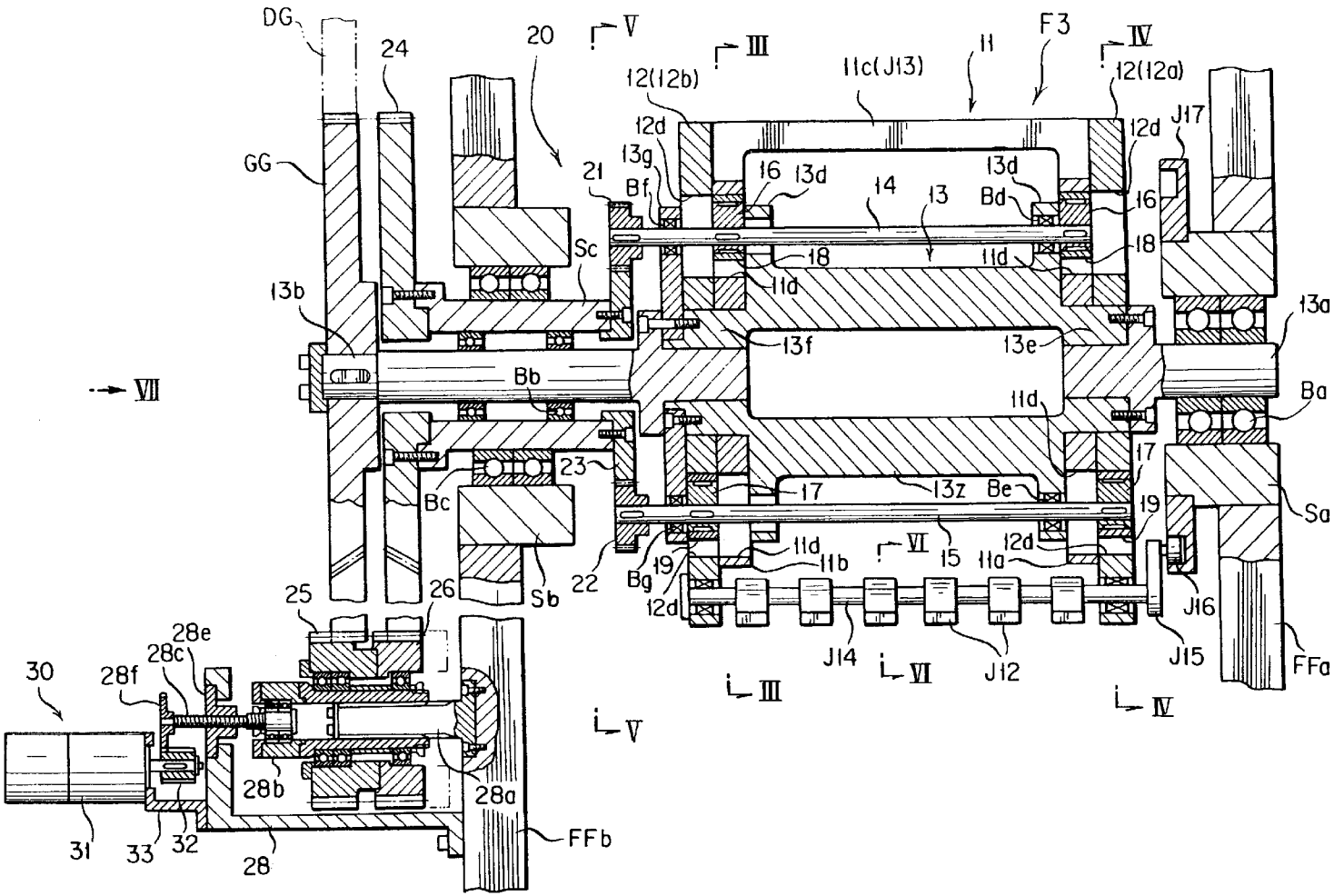
FIG. 2 is a fragmentary, developed sectional view (taken along the planes of lines II—II in FIGS. 5 and 7) of the jaw cylinder of FIG. 1 shown together with jaw spacing adjustment means and drive means therefor.

Both FIGS. 2 and 3 show a series of movable jaw parts $J_{12}$ in each of the jaw cavities $J_{14}$. The movable jaw parts $J_{12}$ are mounted, in a manner to be detailed subsequently, to a jaw carrier shaft $J_{14}$ for joint pivotal motion into and out of web-section-folding engagement with the fixed jaw $J_{13}$. The jaw carrier shaft $J_{14}$ itself is rotatably supported by the pair of outer end plates $\mathbf{12}_a$ and $\mathbf{12}_b$ of the outer end part 12, as better illustrated in FIG. 4. For convenience of description each series of movable jaw parts will be hereinafter referred to collectively as movable jaw, individually as movable jaw parts, and the same reference characters $J_{12}$ will be used in both cases.

Figure 6:
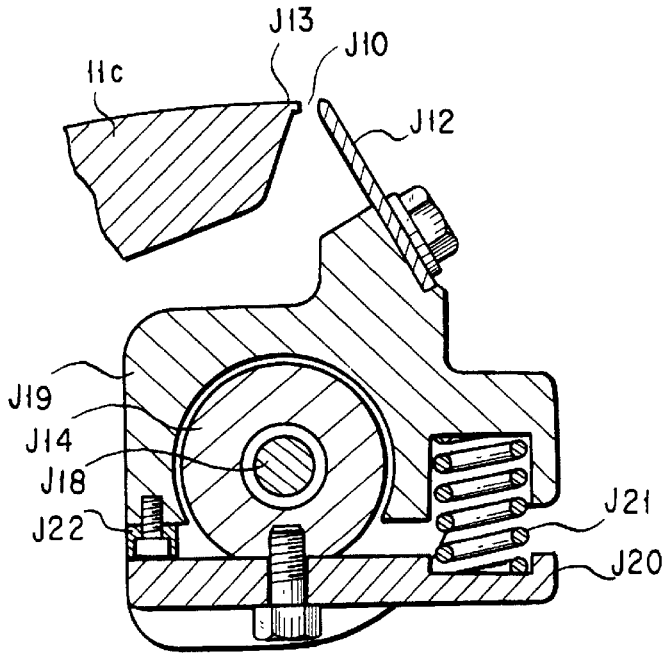
FIG. 6 is an enlarged, fragmentary section taken along the line VI—VI in FIG. 2 and showing one movable jaw part together with the fixed jaw.

FIG. 6 best illustrates how each movable jaw part $J_{12}$ is mounted to the jaw carrier shaft $J_{14}$. Each movable jaw part $J_{12}$ is fastened or otherwise affixed to a movable jaw base $J_{19}$ which in turn is rotatably mounted to the jaw carrier shaft $J_{14}$ via a pair of axially-spaced-apart sleeve bearings which are not seen in this sectional view. A spring seat $J_{20}$ is fastened or otherwise secured to the jaw carrier shaft $J_{14}$ for joint rotation therewith, and a helical compression spring $J_{21}$ is mounted between movable jaw base $J_{19}$ and spring seat $J_{20}$ on one side of the jaw carrier shaft. On the other side of the jaw carrier shaft $J_{14}$, the movable jaw base $J_{19}$ is biased by the compression spring $J_{21}$ into abutment against the spring seat $J_{20}$ via a member $J_{22}$ of wear-resistant material. This figure additionally reveals a torsion-bar spring $J_{18}$ which is built into the jaw carrier shaft $J_{14}$ to bias the same to turn clockwise as viewed in FIG. 6.

The rotation of the jaw carrier shaft $J_{14}$ in a counterclockwise direction, as viewed in FIG. 6, in opposition to the force of the torsion-bar spring $J_{18}$ is therefore imparted to the movable jaw base $J_{19}$ via the spring seat $J_{20}$ and compression spring $J_{21}$, causing the associated movable jaw part $J_{12}$ to move toward the fixed jaw $J_{13}$. Upon clockwise rotation of the jaw carrier shaft $J_{14}$, on the other hand, the spring seat $J_{20}$ will act directly and rigidly upon the movable jaw base $J_{19}$ to cause retraction of the movable jaw part $J_{12}$ away from the fixed jaw $J_{13}$.

With reference back to FIG. 2 the jaw carrier shaft $J_{14}$ rotatably extends through the right hand outer end plate 12*a* and has a crank arm $J_{15}$ mounted fast to its projecting end.

The crank arm $J_{15}$ has a crankpin on which a cam follower roller $J_{16}$ is rotatably mounted for rolling engagement in a groove in a jaw drive cam $J_{17}$ of annular shape. The jaw drive cam $J_{17}$ is immovably mounted to the framing wall $FF_a$ via a bearing sleeve $S_a$.

Thus, with the rotation of the jaw cylinder $F_3$, the cam follower roller $J_{16}$ is to roll along the groove delineated by the jaw drive cam $J_{17}$, thereby causing the crank arm $J_{15}$ to turn bidirectionally. The bidirectional turn of the crank arm $J_{15}$ is imparted directly to the jaw carrier shaft $J_{14}$ and thence, as has been set forth in conjunction with FIG. 6, to the movable jaw parts $J_{12}$ via the movable jaw bases $J_{19}$, spring seats $J_{20}$ and compression springs $J_{21}$. When the movable jaw $J_{12}$ is fully turned toward the fixed jaw $J_{13}$, the compression springs $J_{21}$ will be compressed to variable degrees depending upon the thickness of the folded midpart of the web section PC caught therebetween. The variable degrees of compression of the compression springs $J_{21}$ determine variable amounts of energy thereby stored for acting on the respective movable jaw parts $J_{12}$ in order to cause the same to press the web section PC against the fixed jaw $J_{13}$,

Jaw Spacing Adjustment

As has been mentioned, the fixed jaws $J_{13}$ are formed on the ties $\mathbf{11}_c$ of the inner end part 11 as in FIG. 3, whereas the movable jaws $J_{12}$ are rotatably supported by the pair of outer end plates $\mathbf{12}_a$ and $\mathbf{12}_b$ of the outer end part 12 as in FIG. 4. It has also been stated that the inner end part 11 and outer end part 12 of the jaw cylinder $F_3$ are independently rotatable relative to the core part 13. The spacings between the movable jaws $J_{12}$ and fixed jaws $J_{13}$ are therefore adjustable by varying at least either of the angular positions of the inner end part 11 and outer end part 12 on the core part 13. The inner end part 11 and outer end part 12 are both concurrently angularly displaced in opposite directions by the jaw spacing adjustment 20 in this embodiment of the invention.

Employed for such concurrent angular displacement of the inner end part 11 and outer end part 12, and hence of the movable jaws $J_{12}$ and fixed jaws $J_{13}$, are two camshafts 14 and 15, FIG. 2, which extend parallel to the jaw cylinder axis and which are equidistantly spaced therefrom. The camshaft 14 is designed to cause angular displacement of the inner end part 11, and hence of the fixed jaws $J_{13}$, relative to the core part 13 and so will be hereinafter referred to as the fixed jaw camshaft. The other camshaft 15 will then be hereinafter referred to as the movable jaw camshaft, being designed to cause angular displacement of the outer end part 12, and hence of the movable jaws $J_{12}$, relative to the core part 13. The fixed jaw camshaft 14 and movable jaw camshaft 15 are both rotatably supported by the lugs $\mathbf{13}_d$ of the core part 13 via bearings $B_d$ and $B_e$, and by the retainer plate $\mathbf{13}_g$ via bearings $B_f$ and $B_g$, respectively.

As will be better understood by referring to FIG. 3 in addition to FIG. 2, the fixed jaw camshaft 14 extends through the slots $\mathbf{11}_d$ in the pair of inner end plates $\mathbf{11}_a$, and $\mathbf{11}_b$ and, with clearance, through the slot $\mathbf{12}_d$ in one outer end plate $\mathbf{12}_b$. The fixed jaw camshaft 14 has two fixed jaw cams 16 mounted eccentrically thereon. The fixed jaw cams 16 are rotatably received in annular shoes 18 which in turn are received in the slots 11 in the inner end plates $\mathbf{11}_a$ and $\mathbf{11}_b$ and which are constrained to travel linearly of the slots $\mathbf{11}_d$ and in directions orthogonal to radii of the linearly of the slots $\mathbf{11}_d$ and in directions orthogonal to radii of the inner end plates $\mathbf{11}_a$ and $\mathbf{11}_b$. Thus, when driven bidirectionally, the fixed jaw camshaft 14 will act upon the inner end part 11 via the fixed jaw cams 16 and shoes 18, causing angular displacement of the fixed jaws $J_{13}$ with respect to the core part 13.

A reference to both FIGS. 2 and 4 will make it clear that the movable jaw camshaft 15 acts similarly on the outer end part 12 to cause angular displacement of the movable jaws $J_{12}$. The movable jaw camshaft 15 extends through the slots $\mathbf{12}_d$ in the pair of outer end plates $\mathbf{12}_a$ and $\mathbf{12}_b$ and, with clearance, through the slots $\mathbf{11}_d$ in the pair of inner end plates $\mathbf{11}_a$ and $\mathbf{11}_b$. The movable jaw camshaft 15 has two movable jaw cams 17 mounted eccentrically thereon. These cams 17 are rotatably received in annular shoes 19 which in turn are slidably received in the radial slots $\mathbf{12}_d$ in the outer end plates $\mathbf{12}_a$ and $\mathbf{12}_b$ for linear motion along the same. The bidirectional rotation of the movable jaw camshaft 15 is therefore translated, via the movable jaw cams 17 and shoes 19, into the bidirectional angular displacement of the outer end part 12 around the core part 13, causing the movable jaws $J_{12}$ to travel toward or away from the associated fixed jaws $J_{13}$.

Figure 5:
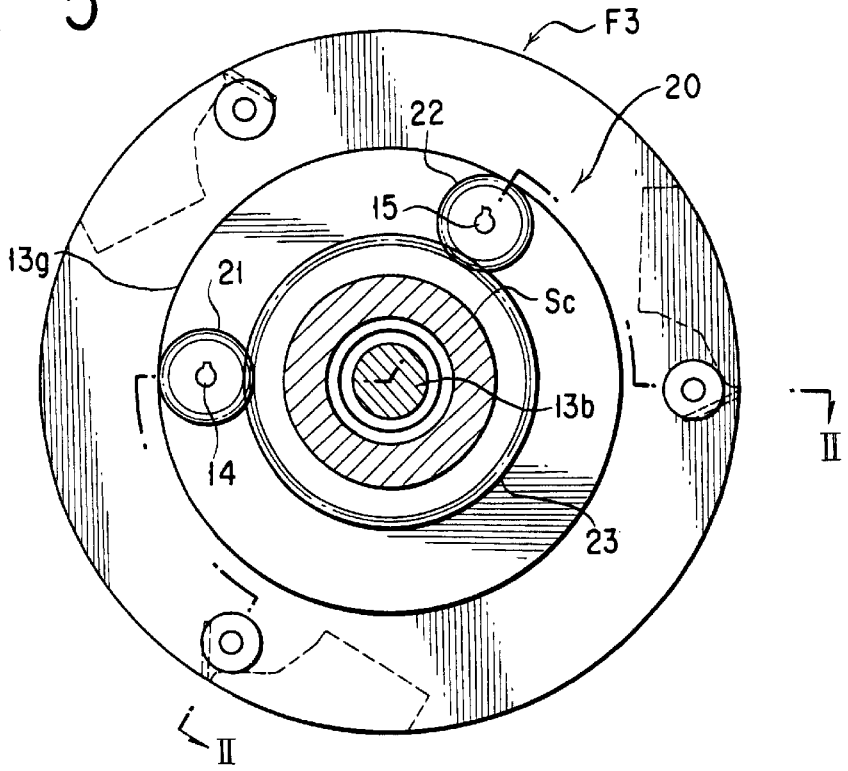
FIG. 5 is a section taken along the line V—V in FIG. 2.

Projecting outwardly of the retainer plate $\mathbf{13}_g$ as in FIG. 2, both fixed jaw camshaft 14 and movable jaw camshaft 15 have pinions 21 and 22 mounted fast thereon. As pictured also in FIG. 5, these pinions 21 and 22 are the same in tooth number, pitch diameter, etc., and both mesh with a jaw spacing adjustment gear 23 which is coaxially fastened to the aforesaid bearing sleeve $S_c$ on the framing wall $FF_b$. Also coaxially fastened to this bearing sleeve $S_c$, on the outside of the framing wall $FF_b$, is another jaw spacing adjustment gear 24 which is a helical gear of the same pitch diameter as the noted helical jaw cylinder drive gear GG on the jaw cylinder journal $\mathbf{13}_b$. The teeth on this jaw spacing adjustment gear 24, however, are twisted in a direction opposite to that of the teeth on the jaw cylinder drive gear GG. The jaw spacing adjustment gear 24 is driven by the drive mechanism 30 to be detailed presently.

Thus, upon rotation of the gear 23 in either direction, the pinions 21 and 22 will rotate in the same direction and at the same speed together with the fixed jaw camshaft 14 and movable jaw camshaft 15. These camshafts 14 and 15 will impart their rotation respectively to the inner end part 11 of the jaw cylinder $F_3$ via the fixed jaw cams 16 and shoes 18 and to the outer end part 12 of the jaw cylinder via the movable jaw cams 17 and shoes 19. The result will be the rotation of the inner end part 11 and outer end part 12 relative to the core part 13 through the same angle but in opposite directions, causing a change in the spacing between movable jaws $J_{12}$ and fixed jaws $J_{13}$ in any given position of the movable jaws relative to the fixed jaws.

Drive Mechanism for Jaw Spacing Adjustment

Figure 7:
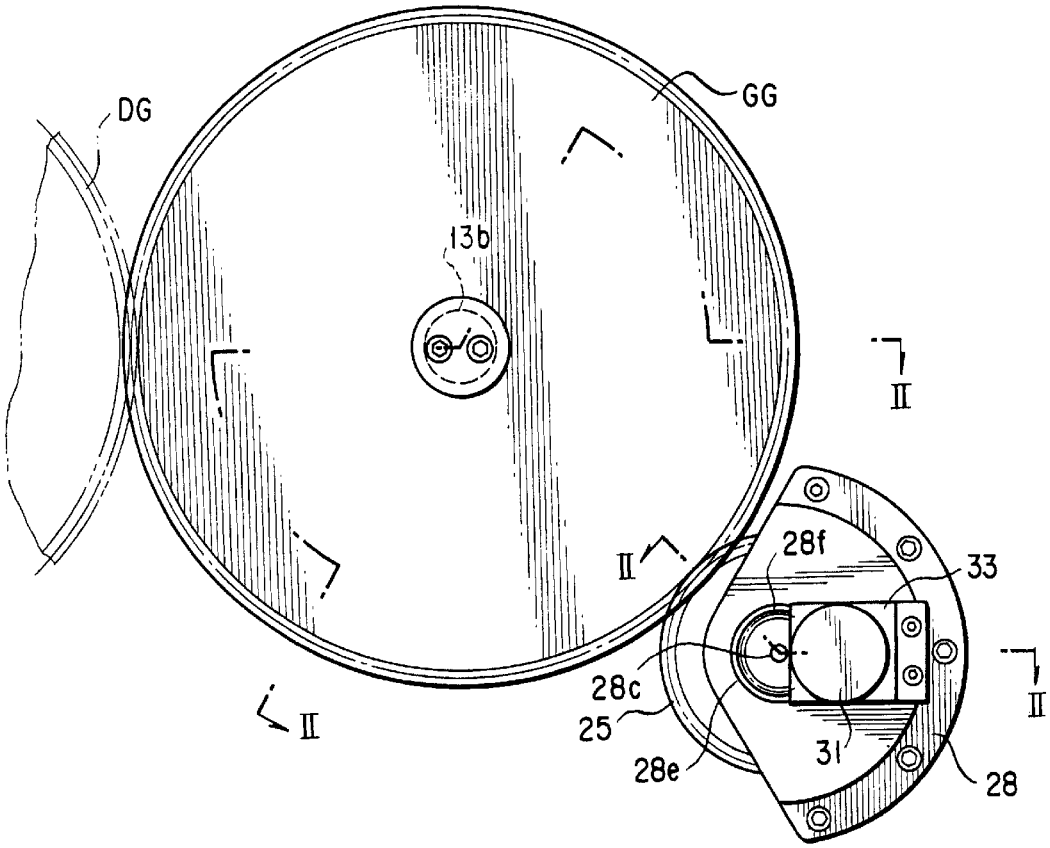
FIG. 7 is an end view of the jaw cylinder apparatus as seen in the direction of the arrow VII in FIG. 2.

FIG. 2 best illustrates the drive mechanism 30 for jaw spacing adjustment, although it appears also in FIG. 7. Included is a bidirectional electric motor 31 which preferably is a stepper motor of itself known construction and which will be hereinafter referred to as jaw spacing adjustment motor or simply as adjustment motor. Bracketed at 33 to a larger bracket 28 on the framing wall $FF_b$, the jaw spacing adjustment motor 31 carries on its armature shaft a drive pinion 32 in mesh with a driven gear $\mathbf{28}_f$. This driven gear is mounted fast to a lead screw $\mathbf{28}_c$ rotatably extending through a nut $\mathbf{28}_e$ nonrotatably supported by the bracket 28. Therefore, upon bidirectional rotation of the adjustment motor 31, the lead screw $\mathbf{28}_c$ will not only rotate but travel axially toward or away from the framing wall $FF_b$ in a direction parallel to the axis of the jaw cylinder $F_3$. It is understood that the drive pinion 32 is of sufficient axial dimension to remain in mesh with the driven gear $\mathbf{28}_f$ throughout the stroke of the lead screw $\mathbf{28}_c$.

The lead screw $\mathbf{28}_c$ is coupled endwise to a movable sleeve $\mathbf{28}_b$ which is mounted to a straight-splined shaft $\mathbf{28}_a$ cantilevered on the framing wall $FF_b$. The lead screw $\mathbf{28}_c$ is rotatable, but restrained from axial displacement, relative to the movable sleeve $\mathbf{28}_b$. It is therefore only the linear motion of the lead screw that is transmitted to the movable sleeve $\mathbf{28}_b$, causing the same to travel linearly back and forth on the straight-splined cantilever shaft $\mathbf{28}_a$. Rotatably mounted on the movable sleeve $\mathbf{28}_b$ are two helical pinions 25 and 26 of substantially one-piece construction jointly movable axially with the movable sleeve. The helical pinions 25 and 26 are in mesh respectively with the helical jaw cylinder drive gear GG and with the helical jaw spacing adjustment gear 24.

Electronic Controls

Figure 8:
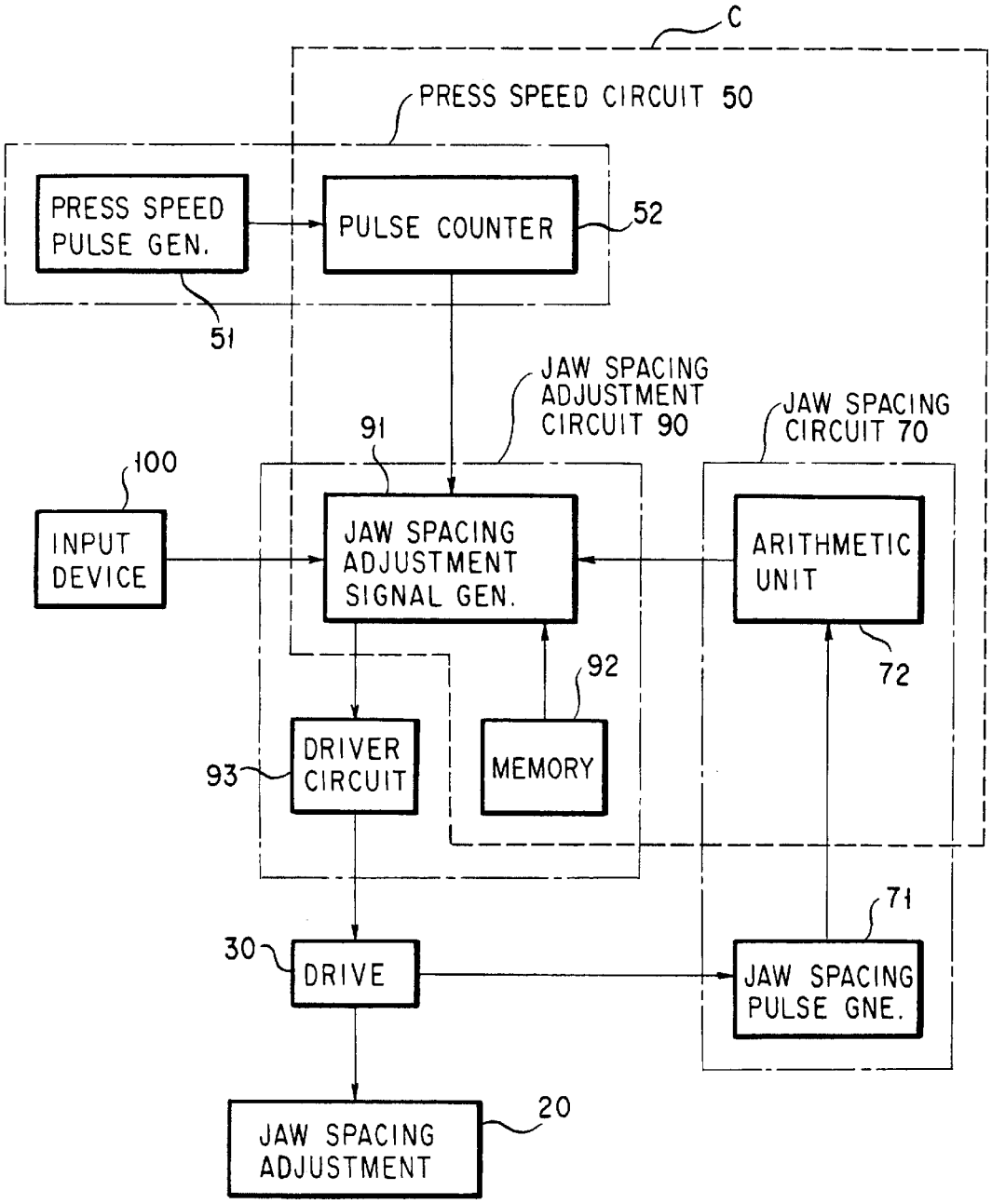
FIG. 8 is a block diagram of the speed-responsive jaw spacing adjustment system for the jaw cylinder apparatus of FIGS. 2–7.

As illustrated block-diagrammatically in FIG. 8, the electronic control system according to the invention is designed to control the jaw spacing adjustment 20 via the adjustment drive mechanism 30. The control system includes a press speed circuit 50 which is shown comprising a press speed pulse generator 51 and a pulse counter 52. In practice the press speed pulse generator 51 may take the form of a rotary encoder mounted to some revolving part of the printing press for provides a series of press speed pulses at a rate proportional to the running speed of the printing press. The pulse counter 52 may then count the incoming press speed pulses during each preassigned period of time and put out a press speed signal indicative of the press speed at that moment. The press speed signal is delivered to a jaw spacing adjustment circuit 90.

Also delivered to the jaw spacing adjustment circuit 90 is a jaw spacing signal indicative of the actual current jaw spacing, from a jaw spacing circuit 70. This circuit 70 is shown as a combination of a jaw spacing pulse generator 71 and an arithmetic unit 72. Here again the jaw spacing pulse generator 71 may take the form of an incremental, bidirectional rotary encoder associated with the bidirectional stepper motor 31 of the jaw spacing adjustment drive mechanism 30 for providing a series of jaw spacing pulses indicative of how the stepper motor 31 is driving the jaw spacing adjustment 20 to vary the spacings between movable jaws $J_{12}$ and fixed jaws $J_{13}$. Bidirectionally counting the jaw spacing pulses, the arithmetic unit 72 determines the actual current jaw spacing at any given phase of the pivotal motion of the movable jaws $J_{12}$ and puts out the jaw spacing signal indicative of that jaw spacing for delivery to the jaw spacing adjustment circuit 90.

Incidentally, the arithmetic unit 72 should be held powered even when the printing press is out of operation. When the press is subsequently set into operation, the arithmetic unit 72 will then provide the jaw spacing signal indicative of the jaw spacing when the machine operation was discontinued.

Inputting both the press speed signal from the press speed circuit 50 and the jaw spacing signal from the jaw spacing circuit 70, the jaw spacing adjustment circuit 90 causes the stepper motor 30, FIG. 2, to be controllably energized for an optimal jaw spacing at the current running speed of the press. The jaw spacing adjustment circuit 90 includes a jaw spacing adjustment signal generator 91 to which are connected not only the press speed circuit 50 and jaw spacing circuit 70 but also an input device 100 for introducing data concerning the thicknesses of the web or webs to be handled at the folding station F, FIG. 1.

More specifically, the input device 100 may be utilized for inputting both the thickness of the paper in use and the number of printed webs that are to be superposed for joint cutting and folding into signatures at the folding station. If the jaw spacing adjustment signal generator 91 is preprogrammed to choose from among a variety of known paper thicknesses, the paper thickness data may be input in terms of the tradename of the paper or of any arbitrary commodity number or name assigned thereto. Similarly, if the jaw spacing adjustment signal generator 91 is preprogrammed to choose from among several possible numbers of webs to be superposed, the web number data may be input in terms of the pages of the signatures to be produced.

Also connected to the jaw spacing adjustment signal generator 91 is a memory 92 on which there is stored Jaw Spacing Table such as that shown below. The Table indicates predetermined optimum jaw spacings for different combinations of different predetermined press speeds and different predetermined numbers of webs to be printed concurrently and processed jointly at the folding station, on the assumption that the paper in use is of standard thickness. The press speeds are given in terms of the number (the unit being 10,000) of signatures produced per hour, and the web number in terms of pages per signature. How the jaw spacing adjustment signal generator 91 utilizes this Table will become apparent in the course of the following description of operation.

JAW SPACING TABLE

| PRESS | PAGES PER SIGNATURE | | | | | | | | | |
|---|---|---|---|---|---|---|---|---|---|---|
| SPEED * | 4 | 8 | 12 | 16 | 20 | 24 | . . . | 40 | 44 | 48 |
| 1 | 0.9 | 1.2 | 1.5 | 1.7 | 1.9 | 2.1 | . . . | 3.1 | 3.3 | 3.6 |
| 2 | 0.9 | 1.2 | 1.5 | 1.7 | 1.9 | 2.1 | . . . | 3.1 | 3.3 | 3.6 |
| 3 | 0.9 | 1.2 | 1.5 | 1.7 | 1.9 | 2.1 | . . . | 3.0 | 3.3 | 3.6 |
| 4 | 0.9 | 1.2 | 1.4 | 1.7 | 1.9 | 2.1 | . . . | 3.0 | 3.3 | 3.6 |
| 5 | 0.9 | 1.2 | 1.4 | 1.6 | 1.9 | 2.1 | . . . | 3.0 | 3.3 | 3.6 |
| 6 | 0.9 | 1.1 | 1.4 | 1.6 | 1.8 | 2.1 | . . . | 3.0 | 3.2 | 3.6 |
| 7 | 0.9 | 1.1 | 1.4 | 1.6 | 1.8 | 2.0 | . . . | 3.0 | 3.2 | 3.5 |
| 8 | 0.9 | 1.1 | 1.4 | 1.6 | 1.8 | 2.0 | . . . | 3.0 | 3.2 | 3.5 |
| 9 | 0.8 | 1.1 | 1.4 | 1.6 | 1.8 | 2.0 | . . . | 2.9 | 3.2 | 3.5 |
| 10 | 0.8 | 1.1 | 1.4 | 1.6 | 1.8 | 2.0 | . . . | 2.9 | 3.2 | 3.5 |
| 11 | 0.8 | 1.1 | 1.3 | 1.6 | 1.8 | 2.0 | . . . | 2.9 | 3.1 | 3.5 |
| 12 | 0.8 | 1.1 | 1.3 | 1.6 | 1.8 | 2.0 | . . . | 2.9 | 3.1 | 3.4 |
| 13 | 0.8 | 1.1 | 1.3 | 1.5 | 1.8 | 2.0 | . . . | 2.9 | 3.1 | 3.4 |
| 14 | 0.8 | 1.1 | 1.3 | 1.5 | 1.7 | 1.9 | . . . | 2.9 | 3.1 | 3.4 |
| 15 | 0.8 | 1.0 | 1.3 | 1.5 | 1.7 | 1.9 | . . . | 2.8 | 3.1 | 3.4 |
| 16 | 0.8 | 1.0 | 1.3 | 1.5 | 1.7 | 1.9 | . . . | 2.8 | 3.0 | 3.4 |
| 17 | 0.8 | 1.0 | 1.3 | 1.5 | 1.7 | 1.9 | . . . | 2.8 | 3.0 | 3.3 |
| 18 | 0.8 | 1.0 | 1.2 | 1.5 | 1.7 | 1.9 | . . . | 2.8 | 3.0 | 3.3 |
| 19 | 0.8 | 1.0 | 1.2 | 1.4 | 1.7 | 1.9 | . . . | 2.8 | 3.0 | 3.3 |
| 20 | 0.7 | 1.0 | 1.2 | 1.4 | 1.6 | 1.8 | . . . | 2.7 | 2.9 | 3.2 |

* × 10,000 signatures per hour.

The jaw spacing adjustment signal generator 91 has its output connected to a motor driver circuit 93 and thence to the stepper motor 31, FIG. 2, of the jaw spacing adjustment drive mechanism 30. The motor driver circuit 93 will controllably energize the stepper motor 31 for rotation in either of two opposite directions, causing the jaw spacing adjustment 20 to adjust the jaw spacing to the particular combination of the current running speed of the press and the number of webs to be processed in superposition. The jaw spacing is additionally adaptable for the thickness of the paper in use even if it deviates from the standard, as will become apparent from the following description of operation.

Operation

Preparatory to the commencement of each printing assignment, the operator or supervisor may introduce both paper thickness data and web number, or signature page, data into the jaw spacing adjustment signal generator 91 from the input device 100. The web of paper W is to be threaded through the folding station F as indicated in FIG. 1. As the printing press is set into operation, the cutter cylinder $F_1$, folding cylinder $F_2$, jaw cylinder $F_3$ and delivery fan $F_4$ will all rotate at the same peripheral speed. Traveling over the folding cylinder $F_2$, the printed web W will be cut into successive sections PC by the cutting blades $F_{11}$ on the cutter cylinder $F_1$ in cooperation with the anvils $F_{22}$ on the folding cylinder.

In a position angularly spaced approximately three fifths of a complete revolution of the folding cylinder $F_2$ from where the web W is cut as above, each web section PC will have its midpart placed opposite one of the jaw cavities $J_{10}$ in the jaw cylinder $F_3$. One of the folding blades $F_{23}$ on the folding cylinder $F_2$ will then push this midpart of the web section PC into the jaw cavity $J_{10}$. Thereupon the movable jaw $J_{12}$ mounted in this jaw cavity will turn toward the fixed jaw $J_{13}$, pressing the inserted midpart of the web section PC against the fixed jaw together with the folding blade $F_{23}$. The movable jaw $J_{12}$ will be so actuated as the crank arm $J_{15}$ on the jaw carrier shaft $J_{14}$ is caused to turn counterclockwise, as viewed in FIG. 6, by the jaw drive cam $J_{17}$ with which the cam follower roller $J_{16}$ travels in constant engagement with the rotation of the jaw cylinder $F_3$. The jaw carrier shaft $J_{14}$ will turn with the crank arm $J_{15}$ against the force of the torsion-bar spring $J_{18}$ built into it.

As will be understood by referring to FIG. 6 again, the counterclockwise rotation of the jaw carrier shaft $J_{14}$ will be transmitted to the movable jaw parts $J_2$ via the spring seats $J_{20}$, compression springs $J_{21}$ and jaw bases $J_{19}$. The movable jaw parts $J_{12}$ will thus resiliently press the midpart of the web section PC against the fixed jaw $J_{13}$ as the compression springs $J_{21}$ undergo compression to variable degrees depending upon the total thickness of the doubled midpart of the web section PC and the folding blade $F_{23}$, the latter being still caught in the former.

With the continued rotation of the folding cylinder $F_2$ and jaw cylinder $F_3$, the folding blade $F_{23}$ will withdraw out of the jaw cavity $J_{10}$ in the jaw cylinder and retract into the folding cylinder, leaving behind the doubled midpart of the web section PC. Then the movable jaw $J_{12}$ will be urged by the compression springs $J_{21}$ to press the midpart of the web section PC against the fixed jaw $J_{13}$ and hence to fold the same along its centerline. Then, again with the continued rotation of the folding cylinder $F_2$ and jaw cylinder $F_3$, the web section PC will come off the folding cylinder and be completely folded over the jaw cylinder.

As the folded web section PC rides over the jaw cylinder $F_3$, the jaw carrier shaft $J_{14}$ will turn clockwise, as viewed in FIG. 6, under the influence of the jaw drive cam $J_{17}$. The torsion-bar spring $J_{18}$ will assist such clockwise turn of the jaw carrier shaft $J_{14}$. Turning clockwise with the jaw carrier shaft $J_{14}$, the movable jaw $J_{12}$ will release the folded web section PC and so allow the same to fall by gravity off the surface of the jaw cylinder $F_3$ into one of the pockets defined by the slanting vanes FA, FIG. 1, on the delivery fan $F_4$. The vanes FA are so angled with respect to this rotational direction of the delivery fan $F_4$ that the folded web section PC will subsequently slide down one of the vanes onto the underlying delivery conveyor FC thereby to be transported to a place of shipment.

The jaw spacing adjustment system according to the invention will be automatically triggered into operation upon commencement of printing. The press speed circuit 50, FIG. 8, will ascertain the running speed of the press whereas the jaw spacing circuit 70 will compute the current spacing between the fixed and movable jaws. More specifically, at the press speed circuit 50, the pulse counter 52 will count the output pulses of the press speed pulse generator 51 during each of successive preassigned periods of time and put out the press speed signal indicative of the press speed in real time.

At the jaw spacing circuit 70, on the other hand, the arithmetic unit 72 will keep counting the jaw spacing pulses from their generator 71 and compute therefrom the actual jaw spacing at some particular operating phase of the jaw spacing adjustment drive means 30, such phase being ascertainable from the incoming jaw spacing pulses. The arithmetic unit will send the resulting jaw spacing signal to the jaw spacing adjustment signal generator 91, to which there will also be fed the press speed signal from the press speed circuit 50.

Each time the input press speed signal renews itself, the jaw spacing adjustment signal generator 91 will respond by reading out from the Jaw Spacing Table on the memory 92 the particular jaw spacing to be established at the particular running speed of the press and with the particular number of webs being processed jointly.

Possibly, the thickness of the paper in use, input through the input device 100, may deviate from the standard thickness on the basis of which the stored Table was formulated. In such cases the jaw spacing adjustment signal generator 91 will compute the jaw spacing to be provided for that thickness of paper, at the current running speed of the press and with the current number of webs, by the equation:

$$L=L_o\times(t/t_o)$$

where

L=the currently desired jaw spacing, $L_o$=the jaw spacing read out from the memory.

t=the thickness of the paper currently in use, and $t_0$=the standard paper thickness.

Then the jaw spacing adjustment signal generator 91 will proceed to compare the thus-computed desired jaw spacing with the actual jaw spacing being indicated at that moment by the jaw spacing signal from the jaw spacing circuit 70. If the difference between the desired and the actual jaw spacing proves to exceed a preset limit, the jaw spacing adjustment signal generator 91 will cause the motor driver circuit 93 to energize the jaw spacing adjustment motor 31. This motor will then rotate in such a direction, and through such an angle, as to optimize the jaw spacing at the current press speed and with the current number of webs being superposed.

The required angle of rotation of the jaw spacing adjustment motor 31 in the required direction will be translated by the lead screw $\mathbf{28}_c$ into the linear travel of the sleeve $\mathbf{28}_b$ on the straight-splined cantilever shaft $\mathbf{28}_a$. The helical pinions 25 and 26 will travel axially with the sleeve $\mathbf{28}_b$. Being in mesh with the helical jaw cylinder drive gear GG, which is locked against axial displacement, the helical pinion 25 on axial displacement will undergo angular displacement, too, together with the second helical pinion 26.

The second helical pinion 26 is itself in mesh with the helical jaw spacing adjustment gear 24, so that this gear will likewise turn upon linear travel of the second pinion 26. Furthermore, since the second pinion 26 itself has been angularly displaced with the first pinion 25 by the jaw cylinder drive gear GG, this angular displacement of the second pinion will also be imparted to the jaw spacing adjustment gear 24. The resulting rotation of this gear 24 will be transmitted via the sleeve $S_c$ to the other jaw cylinder drive gear 23 and thence to the pinions 21 and 22 on the fixed jaw camshaft 14 and movable jaw camshaft 15.

With reference to both FIGS. 2 and 3 the rotation of the fixed jaw camshaft 14, on the one hand, will result in eccentric revolutions of the two fixed jaw cams 16 nonrotatably mounted thereon. Revolving within the annular shoes 18, the fixed jaw cams 16 will cause the shoes to travel linearly along the slots $\mathbf{11}_d$ in the pair of inner end plates $\mathbf{11}_a$ and $\mathbf{11}_b$ of the jaw cylinder inner end part 11 and in directions orthogonal to the radii of the inner end plates. The shoes 18 in so doing will act on the inner end plates $\mathbf{11}_a$ and $\mathbf{11}_b$, causing the entire jaw cylinder inner end part 11 to turn in one direction on the jaw cylinder core part 13.

The rotation of the movable jaw camshaft 15, on the other hand, will likewise result in eccentric revolutions of the two movable jaw cams 17, FIGS. 2 and 4, which are nonrotatably mounted thereon. These cams 17 will revolve within the annular shoes 19 and so cause the same to travel linearly along the slots $\mathbf{12}_d$, in the pair of outer end plates $\mathbf{12}_a$ and $\mathbf{12}_b$ of the jaw cylinder outer end part 12 and in directions orthogonal to the radii of the outer end plates. The complete jaw cylinder outer end part 12 will then rotate in the other direction on the jaw cylinder core part 13.

Thus, as the jaw cylinder inner end part 11 and jaw cylinder outer end part 12 rotate in opposite directions on the jaw cylinder core part 13, so do the fixed jaws $J_{13}$ and movable jaws $J_{12}$ which are supported respectively on the jaw cylinder inner and outer end parts 11 and 12. The spacing between the jaws $J_{12}$ and $J_{13}$ has thus been readjusted and optimized for the current press speed, for the current numbers of webs being processed jointly, and for the current thickness of paper in use.

Referring to FIG. 8 again, the jaw spacing pulse generator 71 in the form of an incremental, bidirectional rotary encoder will put out a series of jaw spacing pulses indicative of the revolutions of the stepper motor 31. The arithmetic unit 72 will respond to each incoming jaw spacing pulse by adding or subtracting one to or from the count that has preexisted at the start of the current jaw spacing adjustment routine. The arithmetic unit 72 will proceed to compute from the modified pulse count the actual jaw spacing that has been readjusted as above, and deliver to the jaw spacing adjustment signal generator 91 the jaw spacing signal suggestive of that actual jaw spacing. The jaw spacing adjustment signal generator 91 will again compare the actual jaw spacing with the desired jaw spacing. The same cycle of operation will be repeated if the result of the comparison exceeds the preset limit, until the difference falls below the limit.

Notwithstanding the foregoing detailed disclosure it is not desired that the present invention be limited by the exact showing of the appended drawings or by the description thereof. For example, the input device 100, FIG. 8, will be unnecessary for those printing press systems in which only one web or only one preselected number of webs are to be processed and in which paper of only one known thickness is always to be used. The speed- and thickness-dependent Jaw Spacing Table above will then be modified and simplified, all that has to be stored on the memory 92 in that case being the desired jaw spacings at the various rates of signature production. Furthermore, as indicated by the dashed outline in FIG. 8, the press speed pulse counter 52 of the press speed circuit 50, the arithmetic unit 72 of the jaw spacing circuit 70, and the jaw spacing adjustment signal generator 91 and memory 92 of the jaw spacing adjustment circuit 90 may be integrated into one electronic processing unit C.

All these and other modifications, alterations and adaptations of the illustrated embodiment are intended in the foregoing disclosure. It is therefore appropriate that the invention be construed broadly and in a manner consistent with the fair meaning or proper scope of the claims which follow.

What is claimed is:

1. A speed-responsive jaw spacing adjustment system for a jaw cylinder at the folding station of a web-fed printing press where a printed paper web is cut into successive sections, and each web section folded into a signature, the jaw cylinder having a fixed and a movable jaw which are mounted to separate, independently movable parts of the jaw cylinder, the movable jaw being movable relative to the independently movable parts of the jaw cylinder toward and away from the fixed jaw for engaging and folding each web section as its midpart is inserted between the fixed and the movable jaw, the speed-responsive jaw spacing adjustment system comprising:

(a) jaw spacing adjustment means coupled to the individually movable parts of the jaw cylinder for moving the fixed and the movable jaw toward and away from each other in order to adjustably vary the spacing therebetween in any operating phase of the movable jaw relative to the fixed jaw;

(b) drive means coupled to the jaw spacing adjustment means for bidirectionally driving the same;

(c) a press speed circuit for providing a press speed signal indicative of the speed at which the web is currently being fed into the folding station;

(d) a jaw spacing circuit for providing a jaw spacing signal indicative of an actual spacing between the fixed and the movable jaw; and (e) a jaw spacing adjustment circuit having inputs connected to the press speed circuit and to the jaw spacing circuit for providing, in response to the press speed signal and the jaw spacing signal, a jaw spacing adjustment signal for adjustment of the jaw spacing to the current web speed, the jaw spacing adjustment circuit having an output connected to the drive means for causing the same to drive the jaw spacing adjustment means in response to the jaw spacing adjustment signal.

2. The speed-responsive jaw spacing adjustment system of claim 1 wherein the jaw spacing circuit is coupled to the drive means for ascertaining the actual spacing between the fixed and the movable jaw.

3. A speed-responsive jaw spacing adjustment system for a jaw cylinder at the folding station of a web-fed printing press where a printed paper web or any required number of such webs in superposition are cut into sections, and each web section folded into a signature, the jaw cylinder having a fixed and a movable jaw which are mounted to separate, independently movable parts of the jaw cylinder, the movable jaw being movable relative to the independently movable parts of the jaw cylinder toward and away from the fixed jaw for engaging and folding each web section as its midpart is inserted between the fixed and the movable jaw, the speed-responsive jaw spacing adjustment system comprising:

(a) jaw spacing adjustment means coupled to the individually movable parts of the jaw cylinder for moving the fixed and the movable jaw toward and away from each other in order to adjustably vary the spacing therebetween in any operating phase of the movable jaw relative to the fixed jaw;

(b) drive means coupled to the jaw spacing adjustment means for bidirectionally driving the same;

(c) a press speed circuit for providing a press speed signal indicative of the speed at which the web is currently being fed into the folding station;

(d) input mean for inputting data indicative of how many webs are processed simultaneously; and (e) a jaw spacing adjustment circuit having inputs connected to the press speed circuit and the jaw spacing circuit and the input means for providing a jaw spacing signal indicative of a desired jaw spacing suiting both the speed at which the web or webs are being processed and the number of webs being processed simultaneously, the jaw spacing adjustment circuit having an output connected to the drive means for causing the same to drive the jaw spacing adjustment means in response to the jaw spacing adjustment signal.

4. The speed-responsive jaw spacing adjustment system of claim 3 wherein the jaw spacing adjustment circuit includes a memory for storing a table indicative of desired jaw spacings for different combinations of a series of different speeds at which the web or webs are to be processed and a series of different numbers of webs to be processed simultaneously.

5. The speed-responsive jaw spacing adjustment system of claim 3 further comprising a jaw spacing circuit connected to the jaw spacing adjustment circuit for delivering thereto a jaw spacing signal indicative of an actual spacing between the fixed and the movable jaw, the jaw spacing adjustment circuit being responsive to the jaw spacing signal to reduce the difference between the desired and the actual jaw spacing.

6. The speed-responsive jaw spacing adjustment system of claim 5 wherein the jaw spacing circuit is coupled to the drive means for ascertaining the actual spacing between the fixed and the movable jaw.

* * * * *